US010068435B2

(12) United States Patent
Gugler

(10) Patent No.: US 10,068,435 B2
(45) Date of Patent: Sep. 4, 2018

(54) GAMING MACHINE INCLUDING WIN CHAINS

(71) Applicant: Novomatic AG, Gumpolskirchen (AT)

(72) Inventor: Martin Gugler, Baden (AT)

(73) Assignee: Novomatic AG, Gumpoldskirchen (AT)

( * ) Notice: Subject to any disclaimer, the term of this patent is extended or adjusted under 35 U.S.C. 154(b) by 0 days.

(21) Appl. No.: 15/230,095

(22) Filed: Aug. 5, 2016

(65) Prior Publication Data

US 2016/0371937 A1 Dec. 22, 2016

Related U.S. Application Data

(63) Continuation of application No. 13/757,552, filed on Feb. 1, 2013, now Pat. No. 9,412,239.

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3209* (2013.01); *G07F 17/3211* (2013.01); *G07F 17/3267* (2013.01)

(58) Field of Classification Search

CPC .. G07F 17/32; G07F 17/3244; G07F 17/3258; G07F 17/3267

See application file for complete search history.

(56) References Cited

U.S. PATENT DOCUMENTS

| | | | | |
|---|---|---|---|---|
| 8,267,770 | B2 * | 9/2012 | Mizue | G07F 17/34 463/20 |
| 8,574,053 | B1 * | 11/2013 | Nelson | G07F 17/3258 463/16 |
| 2007/0135193 | A1 * | 6/2007 | Nicely | A63F 1/00 463/11 |
| 2009/0124330 | A1 * | 5/2009 | Leger | G07F 17/32 463/20 |
| 2014/0087829 | A1 * | 3/2014 | Watkins | G07F 17/32 463/20 |

* cited by examiner

*Primary Examiner* — James S McClellan
*Assistant Examiner* — Kevin Carter
(74) *Attorney, Agent, or Firm* — Kevin H. Fortin

(57) ABSTRACT

A gaming machine having a standard game play mode and a bonus feature play mode that include winning and non-winning reel set spins. The gaming machine includes a housing having a user interface and a display attached to the housing to enable games having standard and bonus game play modes. Standard game play mode displays a matrix of symbols including scatter symbols. The gaming machine evaluates scatter symbols in the matrix, whereby appearance of a predetermined number of scatter symbols in the matrix triggers bonus feature play mode and initializes a win chain counter. During bonus game play mode a winning reel set spin enables a new reel set spin while leaving the value of the win chain counter unchanged and a non-winning reel set spin decrements the win chain counter. When the win chain counter reaches a threshold value then bonus game play mode terminates.

16 Claims, 7 Drawing Sheets

GAMING MACHINE INCLUDING WIN CHAINS

CROSS-REFERENCE TO RELATED APPLICATIONS

This patent application is a continuation of co-pending U.S. patent application Ser. No. 13/757,552, filed Feb. 1, 2013, the disclosure of which is incorporated herein by reference.

FIELD OF THE INVENTION

The invention pertains to gaming machines including slot machines, and particularly to slot machines having in chains as bonus feature play.

BACKGROUND OF THE INVENTION

In the gaming machine industry, there is a continuing need for gaming machine manufacturers to produce new types of games, or enhancements to existing games, which will attract frequent play by enhancing the entertainment value and excitement associated with the game. Presently, there is a trend with slot machines to offer additional games that can be played in addition to the standard game play involving spinning reels. These additional games are often referred to as a "feature game", or "bonus game".

EP0874337A1 of Demar Lawrence E. and Frohm Erica disclose a gaming machine is operated by a programmed micro-processor in which the first mode of operation, a basic gambling game, is implemented such as video poker or reel-type slot machine play. If bonus symbols are selected in, the basic mode, a bonus mode is triggered. In the bonus mode the same or a different game is implemented by the micro-processor system employing a Bernoulli trial procedure in which the player continues to play and receive awards until a losing combination occurs. The hit rate for the bonus mode is greater than 50% although the overall pay out percentage of the game remains below 100%.

U.S. Pat. No. 7,258,611 B2 to Bigelow, Jr. et al. discloses a slot-machine. Slot machines receive payments either electronically, in cash, or tokens. Payouts are enabled by winning reel-set spins. The slot machine of Bigelow, Jr. et al includes a bonus game, and particularly a free spin bonus with an incrementing multiplier. The bonus game includes a plurality of reels having a plurality of symbols and multipliers. The gaming device provides a number of free spins to the player at the beginning of the bonus game. The multiplier preferably starts at "1 times." and increases by one after each free spin. Initially, the player spins the reels attempting to obtain a winning symbol combination on the reels. If the player obtains a winning combination, the gaming device provides an award. The award is multiplied by the multiplier and the player receives the multiplied award for that free spin. The player continues to spin the reels until there are no free spins remaining in the bonus play.

However, in both of these patent documents, the game may not continue once the players lose. Moreover, no cumulative credits are awarded upon termination of the bonus game play.

The gaming industry is very competitive and evolving continuously. Although, many games continue to entertain gaming enthusiasts, there is still an unmet need for better and more interesting games and features. There is also an unmet need for making gaming experience user-friendly to enable a player to readily understand the various gaming features and available variations thereof, particularly with respect to the feature games that follow different rules than the standard slot machine reel play.

SUMMARY OF THE INVENTION

A gaming machine having a standard game play mode and a bonus feature play mode, the machine comprises at least one user interface attached to a housing; a computer in operative communication with the user interface and having a printed circuit board mounted with a program memory for storing the game play instructions and a set of symbols, a main processor and RAM, all connected in an operative communication with each other and also connected with an input/output controller.

A user interface control panel connects to the input/output controller at one end and connects to the user interface at the other end, the control panel enables the user to input, instructions to initiate and/or continue game play.

The gaming machine has at least one input device including at least one of: a coin receiver, a ticket receiver and a currency receiver connected in an operative communication with the input/output controller to communicate the value of any bet in terms of coins/currency/ticket received therein. The gaming machine includes a ticket reader and/or printer.

The user interface includes a button to enable a user to commence standard game play mode or bonus feature play mode and another button to enable a user to select at least one bet.

The game play instructions include instructions for the standard game play mode and for the bonus feature play mode. During the standard game play mode, the user interface displays a matrix of symbols presented over a plurality of reels and spread horizontally. Each reel represents a plurality of symbols displayed in a single column and the computer calculates the wins based on the symbols randomly arranged within the matrix including scatter symbols and other symbols or a pay line otherwise yielding a win. On appearance of a predetermined number of scatter symbols in the matrix of symbols, a bonus feature play commences and these scatter symbols yields the respective "Winning Seasons" which in turn includes an uninterrupted series of winning spins or "Win Chains". The bonus feature play starts with a winning spin and terminates when a spin produces a non-winning combination only on exhausting all the available "Winning Seasons".

The input device includes a card reader connected in an operative communication with the input/output controller to read details of the card inserted therein.

The input/output controller is connected to a sound circuit in operative communication with at least one speaker.

The user interface is configured as a digital video display unit to display a matrix of symbols arranged in at least three rows and five columns for imitating a mechanical slot machine reels in the standard game play mode and each column includes at least three symbols being displayed vertically in a random sequence.

The digital video display unit is disposed angled with respect to the floor to optimally face a user.

The digital video display unit is connected to the input/output controller via an interface driver circuitry.

The user interface is a combination of digital and mechanical reel components and the user interface also provides images that overlay the mechanical reels.

The user interface includes a further display unit being transmissive to facilitate highlighting of any of the symbols and paylines to facilitate the game play.

A "Win Chain" is recorded for each win whether from a scatter symbol or a pay line and from a bonus feature play result.

The bonus feature play commences when at least three scatter symbols appear.

The bonus feature play is extended when three or more scatter symbols appear.

One embodiment includes a gaming machine having a standard game play mode and a bonus feature play mode. The gaming machine includes at least one user interface configured as a digital video display unit and attached to housing. The digital video display is disposed at an angle with respect to the floor to optimally face a user for displaying a matrix of symbols arranged in at least three rows and five columns for imitating the mechanical slot machine reels in the standard game play mode.

Each column includes at least three symbols displayed vertically in a random sequence. The digital video display unit connected to the input/output controller via an interface driver circuitry. The digital video display unit includes an integrated touch-screen and a transmissive unit to facilitate highlighting of any of the symbols and paylines to facilitate the game play.

The gaming machine includes a computer in operative communication with the user interface and having a PCB mounted with a processor, a program memory, and RAM, which are all connected in an operative communication with each other and also connected with an input/output controller. The program memory stores the game play instructions and a set of symbols. A user interface control panel connects to the input/output controller at one end and connected to the user interface at the other end to enable the user to input instructions to initiate and/or continue game play.

A method of operating the gaming machine includes the steps of: (i) operating a standard game play mode during which the user interface displays a matrix of symbols spread over an imitation of a plurality of reels spread horizontally, each reel representing a plurality of symbols displayed in a single column; (ii) calculating the wins during a spin based on the symbols randomly arranged within the matrix, including the appearance of the scatter symbols; (iii) recording each win whether from the scatter symbols or a pay line otherwise yielding a win, including a series of wins being recorded as a "Win Chain"; (iv) continuing the free games until a losing spin occurs; (v) awarding a bonus feature play as the "Winning Seasons" when a predetermined number of scatter symbols appear on the display; (vi) notifying the user about winning the "Winning Seasons" in the standard game play mode and querying if the player accepts to play bonus feature play; (vii) on acceptance by the player, automatically initiating a bonus feature play and converting the matrix of symbols on the display into the bonus feature play images; (viii) enabling a plurality of "Win Chains" under "Winning Seasons", each of the "Win Chain" including an uninterrupted series of "Winning Spins" offered as free spins and thus offering additional winning opportunities; (ix) continuing the "Winning spin" of the "Win Chain" until a "Non-Winning Spin" appears and continuing the bonus feature play to the next available "Win Chain" and terminating" the bonus play feature on appearance of the "Non-Winning Spin" only on exhausting all the available "Winning Seasons".

In the standard game play, a bonus feature play is awarded as the "Winning Seasons" on appearance of at least three scatter symbols.

At least three win chains are achieved during the game play, whether via a standard game play or via a bonus feature play.

During the bonus feature play, the additional credits are awarded which can be added to the total credits.

The payout calculations in the bonus feature play are same as the standard game play by evaluating the symbol values on the pay line, i.e. a winning combination may be three of a kind, four of a kind, or five of a kind etc. on the respective pay line.

Instead of awarding additional credits, a "Win Chain" is awarded to create a higher bet and thus a correspondingly higher payout for a particular spin.

Instead of awarding additional credits, a threshold number of "Win Chains" is utilized to double or triple any payout as an alternative to awarding credits.

A base payout value may be provided and a kind of multiplier values may be cumulated to multiply this base payout or credit.

DETAILED DESCRIPTION

Figure 1:
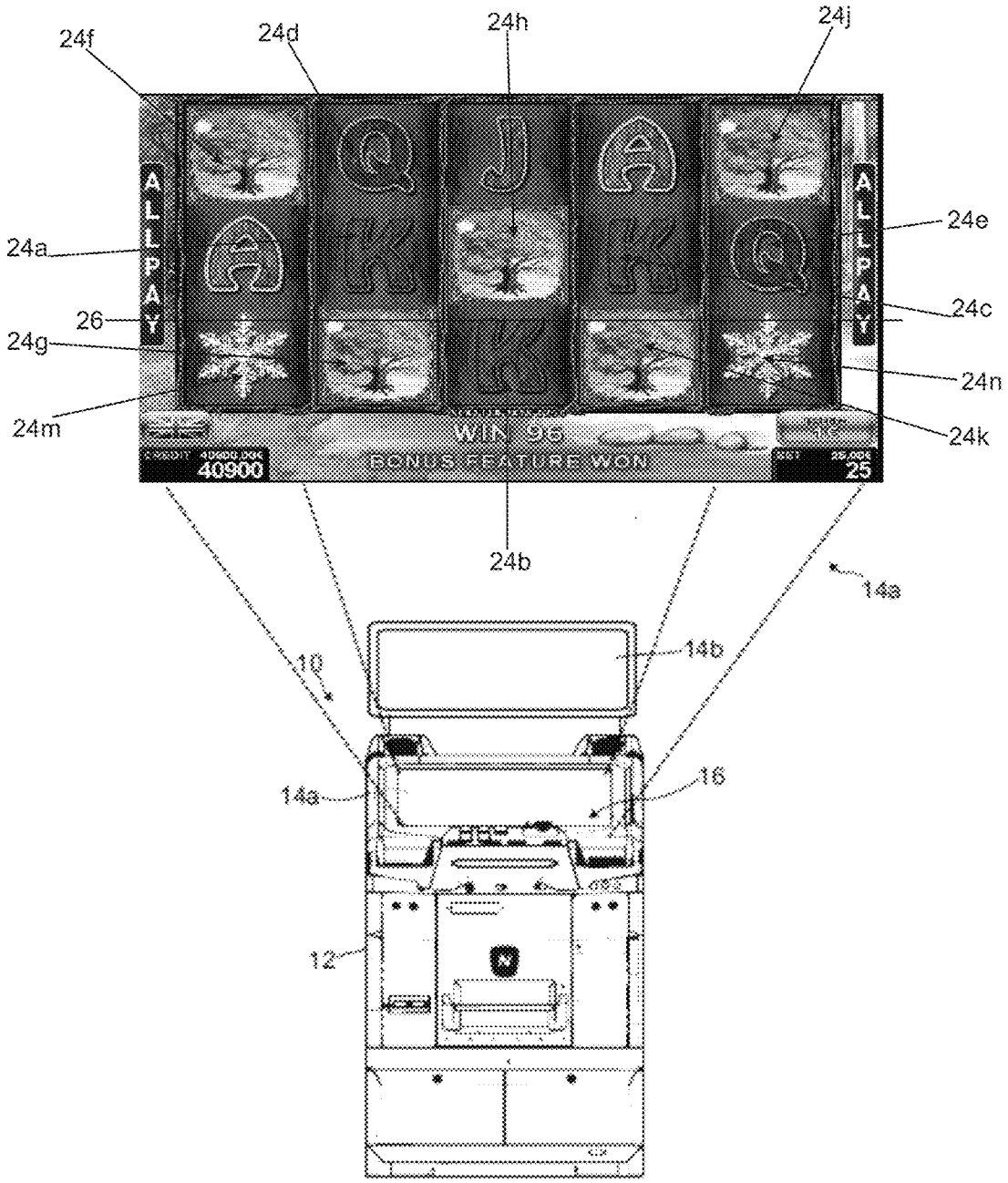
FIG. 1 is a front view of a housing displaying a slot machine reel.

FIG. 1 shows a gaming machine 10. The gaming machine 10 is a slot-machine capable of various game play modes. Initially the gaming machine 10 operates in a standard game play mode until the occurrence of a random event, and then the gaming machine 10 operates in a bonus feature play mode. In standard game play mode, a matrix of symbols are displayed in a format which includes an imitation of a mechanical reel with a matrix of five reels in columns and each reel having three symbols running vertically.

The gaming machine 10 is preferably a slot machine which includes a housing 12 with a lower display 14*a*, an upper display 14*b* and a user interface 16. The slot machine is broadly construed as any gaming machine that is capable of enabling a player to play for entertainment with a probability of a payout.

The interface 16 is supported by the housing 12. The interface 16 optimally faces a user, who may be standing or sitting in proximity to the machine 10. The interface 16 enables user to input his choice to initiate and/or continue the game play. In particular, a number of buttons can be presented on the interface to enable a user either to commence the standard game play mode, or continue further the bonus feature play mode by selecting bets for playing a plurality of win seasons each having at least one chain and the maximum probable length of the win chains is potentially infinite.

According to one aspect of the invention, the display 14*a* is configured to display a matrix of symbols 24 that imitate the mechanical slot machine reels in the standard game play mode to one aspect of the invention. Accordingly, each column of the matrix imitates a single mechanical slot machine reel. The display 14*a* is disposed angled with respect to the floor to optimally face a user.

In another embodiment of the invention, it is contemplated that the display 14*a* may include a hybrid arrangement having both digital and mechanical components. The display 14*b* is transmissive to facilitate highlighting of any of the various symbols, and paylines to facilitate the game play. Here, the interface also provides images that overlay the mechanical reels.

The matrix of symbols 24 has three rows and five columns. The matrix of symbols 24, however, may include any number of rows and columns in accordance with various game formats. As shown, the matrix of symbols 24 includes a plurality of symbols 24*a*, 24*b*, 24*c*, 24*d* and 24*e*, and scatter symbols 24*f*, 24*g*, 24*h*, 24*j*, 24*k*, 24*m* and 24*n* etc.

Scatter symbols 24*f*, 24*g*, 24*h*, 24*j* 24*k*, 24*m* and 24*n* are special symbols because they have the potential to directly or indirectly lead to larger payouts. The icon on the scatter symbol 24*f*, 24*g*, 24*h*, 24*j*, 24*k*, 24*m* and 24*n* is usually closely associated to an important aspect of the theme of the online slot because of its importance. Scatter symbols 24*e*, 24*f*, 24*g*, 24*h*, 24*j*, 24*k*, 24*m* and 24*n* can contrast with other symbols 24*a*, 24*b*, 24*c*, 24*d* and 24*e*, so that they can be easily seen among a matrix of symbols. The scatter symbols 24*e*, 24*f*, 24*g*, 24*h*, 24*j*, 24*k*, 24*m* and 24*n* can also be made brighter or more animated than other symbols, for example. Scatter symbols 24*f*, 24*g* 24*h*, 24*j*, 24*k*, 24*m* and 24*n* differ from other symbols in that they simply lead to improved payouts and additional credits, rather than replace other symbols as a wild card functions in a card game play, for example.

In another aspect of the invention, the gaming machine 10 presents a poker-style game. The matrix of symbols 24 includes the playing card values, such as King, Jack, Queen, and various numerical card values. The matrix of symbols 24 may also include any other symbols that create interest to a player including the scatter symbols 24*f*, 24*g*, 24*h*, 24*j* and 24*k*. Although, a poker-based theme is described herein, it can be appreciated that the present invention may also encompasses non-poker based themes without departing from the scope of the present invention.

The symbols 24 can also include still images, or video-streamed images, or a combination thereof. Such still images or video streamed images or any combination thereof, may be displayed using a combination of physical reels and virtual reels. Video streamed images enable the symbols 24 to yield an evolving appearance. In particular, the size, character and the transparency of the symbols may change during the game play, particularly upon the appearance of a scatter symbol. When physical reels are also used, the images may be highlighted or changed, for example, by using a projection using transmissive technology on the display 14*a*.

The display 14*a* shows any number of paylines crossing horizontal and vertical rows and columns, respectively. In particular, a payline 26 is shown extending horizontally across the third row of the matrix of symbols 24. Any of a variety of paylines can be defined on the display 14*a*, including the vertical, diagonal and irregular pay lines. All prizes are for the combinations of a kind. However, the prizes are for the combinations in the matrix running from left to right only. Moreover, the scatter symbols pay at any position on the screen. The highest win is only paid per combination on the screen. All prizes are shown in credits. It is to be noted that any malfunction of the game voids all pays and plays.

The payline 26 crosses through the top row of the matrix of symbols and is projected on the display 14*a* and thereby indicates a payout. According to the rules for the game play, on appearance of at least three scatter symbols in the standard game play mode, a bonus feature play mode is initiated. In other embodiments of the invention, the bonus feature play mode may be initiated even when four or five scatter symbols appear, respectively.

Here, five scatter symbols 24*f*, 24*g*, 24*h*, 24*j* and 24*k* appear and enable the bonus feature play, so that the payout is according to the payline 26. Preferably, the bonus feature play mode is automatically initiated and accepted by enabling a user by activating a button on the interface 16. The matrix of symbols disappears and it is completely replaced by the bonus feature play images when the gaming machine 10 enters in the bonus feature play mode. However, it may be appreciated that the variants of the invention can retain a portion of the information and symbolism presented from standard game play mode in the bonus feature play mode, such as a bet amount.

Figure 2:
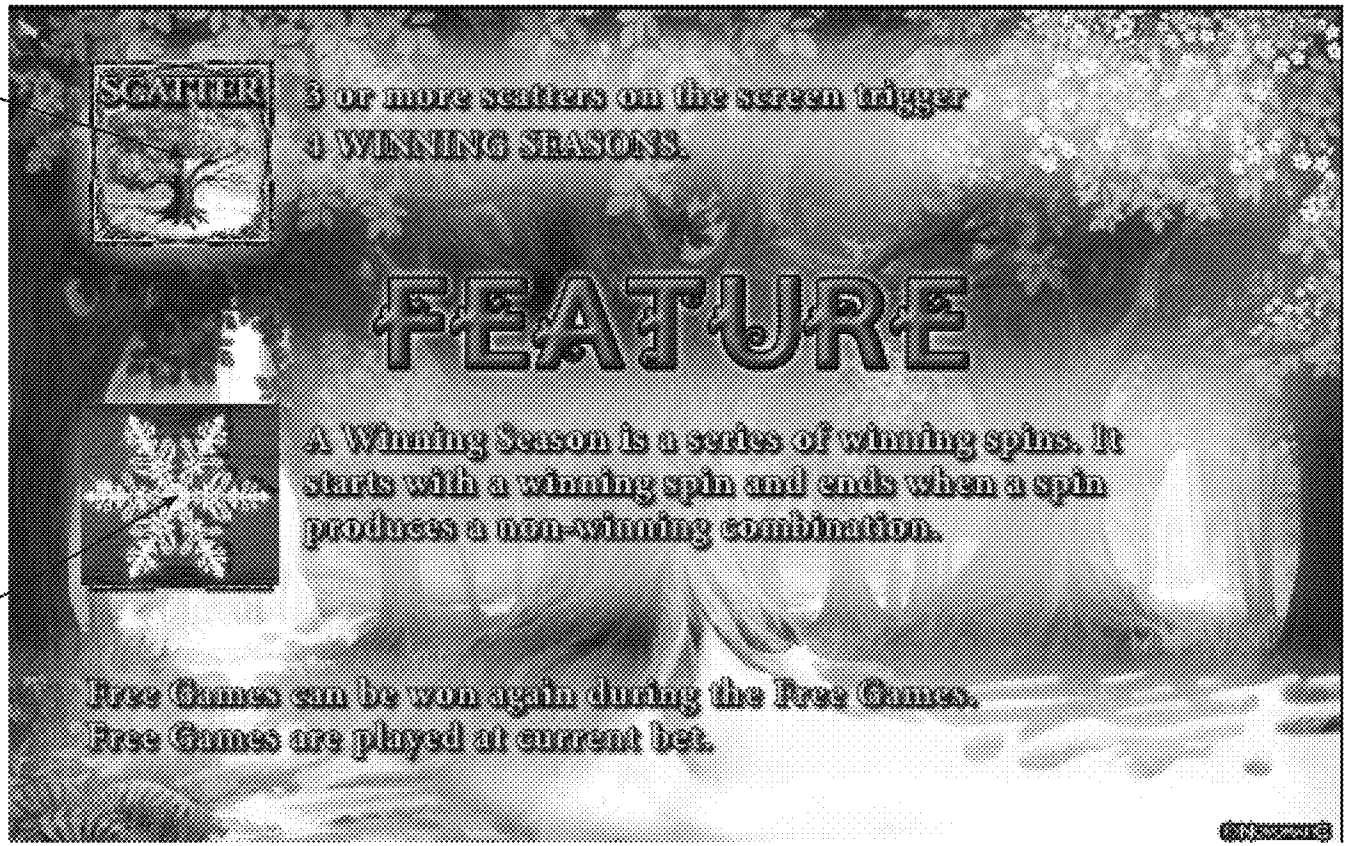
FIG. 2 is a screenshot of the bonus feature play in accordance with the present invention depicted on the display.

FIG. 2 shows the display 14*a* in the bonus feature play mode. Features of the bonus feature play mode are depicted here. Accordingly, winnings can be achieved by the appearance of a scatter symbol, or by a pay line otherwise yielding a win. The scatter symbols also yield in a new bonus feature play represented here as the "Winning Season" which enables free spins and more wining opportunities when 3 or more scatter symbols appear. This bonus feature play starts with a winning spin and terminates when a non-winning combination appears only on exhausting all the available "Winning Seasons". One of the scatter symbol 24*f* is shown and it is illustrated that on appearance of three or more such scatter symbols, four winning seasons are won. The figure further illustrates that a winning season is a series of winning spins.

A characteristic advantage of this bonus feature play is that free games can be won again during the free games. The free games are played at the current bet itself. But, this bonus feature play can be extended when three or more scatter symbols appear. In accordance with the present invention, the free games can be won as "Win Chains" and the players can win a certain number of "Win Chains". Here, a "Win Chain" is meant by an uninterrupted series of winning spins. The minimum number of a win chain is a single winning spin; however, the maximum possible length of a win chain is potentially infinite. A win chain is recorded for each win (yielding a series of wins), whether from a scatter symbol or a payline, and from a bonus feature play having these results.

An important advantage of the present invention is to award a series of wins in order to allow the player to continue playing free games until a non-winning spin occurs, so the bonus feature play is possible as long as the winning spins continue.

Yet another important advantage of the present invention is that if at least three win chains are achieved during the game play, whether via a normal game play or via a bonus feature play, the cumulative credits may be awarded, which can be added to the total credits.

A still further advantage of this invention is that "Win Chains" enable the bonus feature play to continue infinitely, i.e. it may go on endlessly, if the winning spins continue.

The payout calculations in the bonus feature play may be similar to the normal game play by evaluating symbol values on the pay line, i.e. a winning combination may be three of a kind, four of a kind, or five of a kind etc. on the respective pay line.

The most important object of the present invention with the concept of "Win Chains" is to encourage a player to sit for the game play for a considerably longer period. The bonus feature play, which may potentially be infinite, if the winning spins continue, induces the player to sit longer as the perspective of a long series of free games is embedded in this bonus feature play in accordance with the present invention.

Another possibility of the present invention is that a "Win Chain" award may optionally be used to create a higher bet and so to award a correspondingly higher payout for a particular spin, instead of awarding additional credits. This way, a threshold number of "Win Chains" may be utilized, e.g. to double or triple any payout as an alternative to awarding credits. Thus, a base payout value may be provided and a kind of multiplier values may be cumulated to multiply this base payout (credit).

Figure 3:
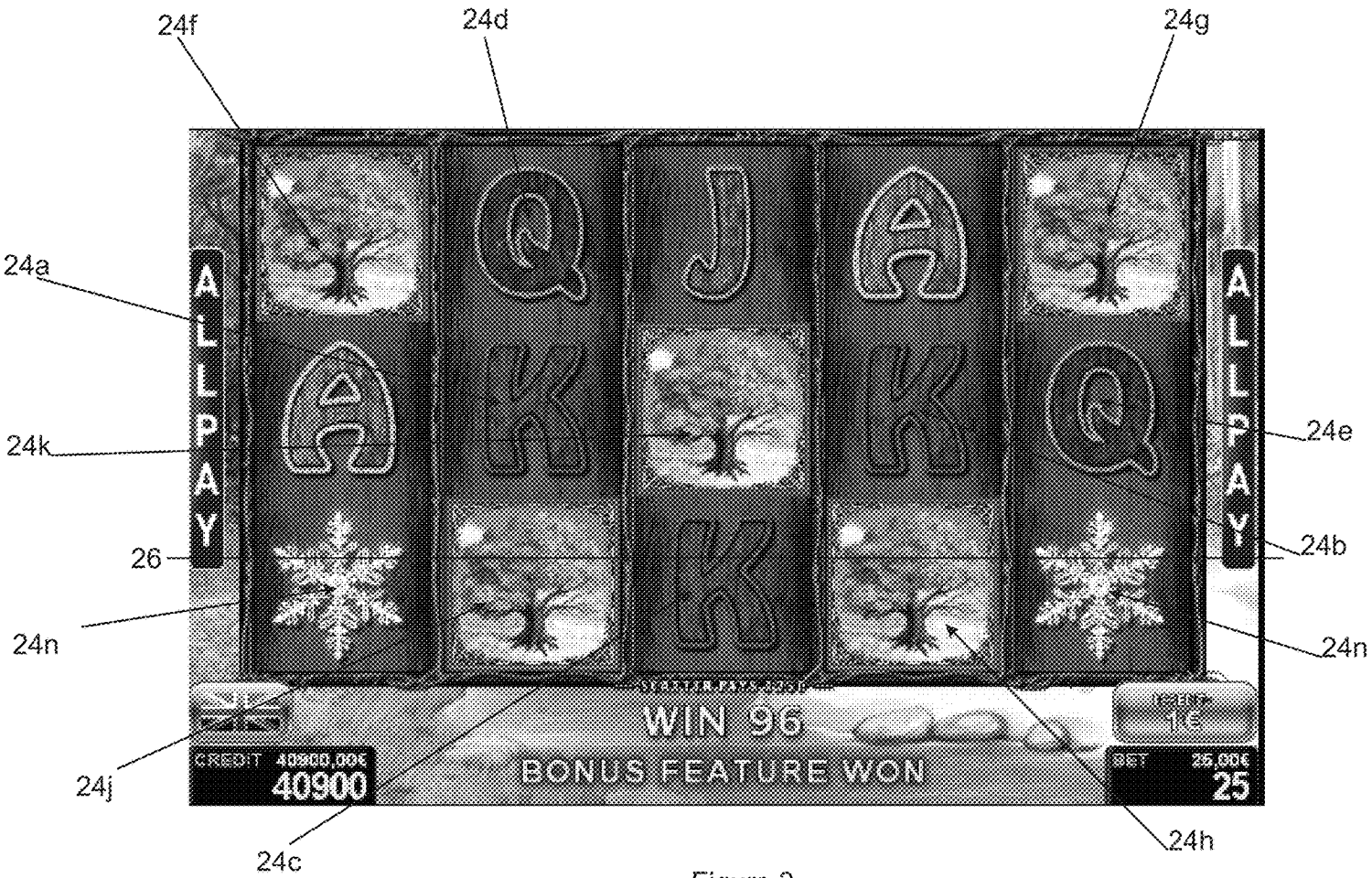
FIG. 3 is a screenshot of the display depicted after winning a bonus feature play in accordance with the present invention.

FIG. 3 shows the snapshot when a bonus feature play is won by a pay line 26 in the lower row. No more than one scatter symbol 24 is present in any single column. The payline 26 shows two scatter symbols 24*h* and 24*j*, one "K" symbol 24*c* and two "Star" symbols. Accordingly, a payout commensurate with the appearance of these symbols indicated on the payline 26 is indicated.

Figure 4:
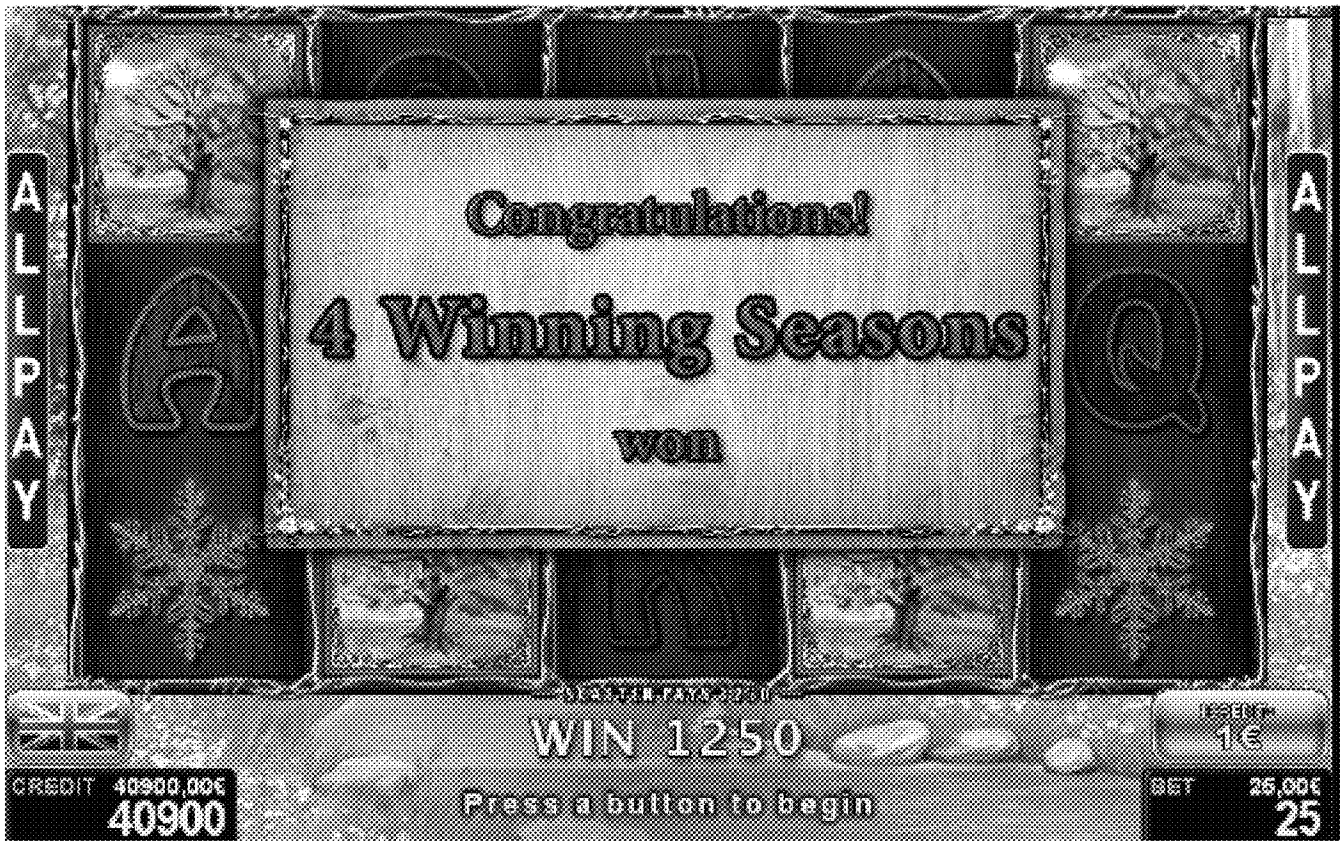
FIG. 4 is a screenshot of the notification of display after winning the "Winning Seasons" in accordance with the present invention.

FIG. 4 shows the display 14*a* in a bonus feature play. A "Congratulations!" message is displayed for winning the "4 Winning Seasons" and the player is asked to press the button on the user interface 16 to begin the bonus feature play.

Figure 5:
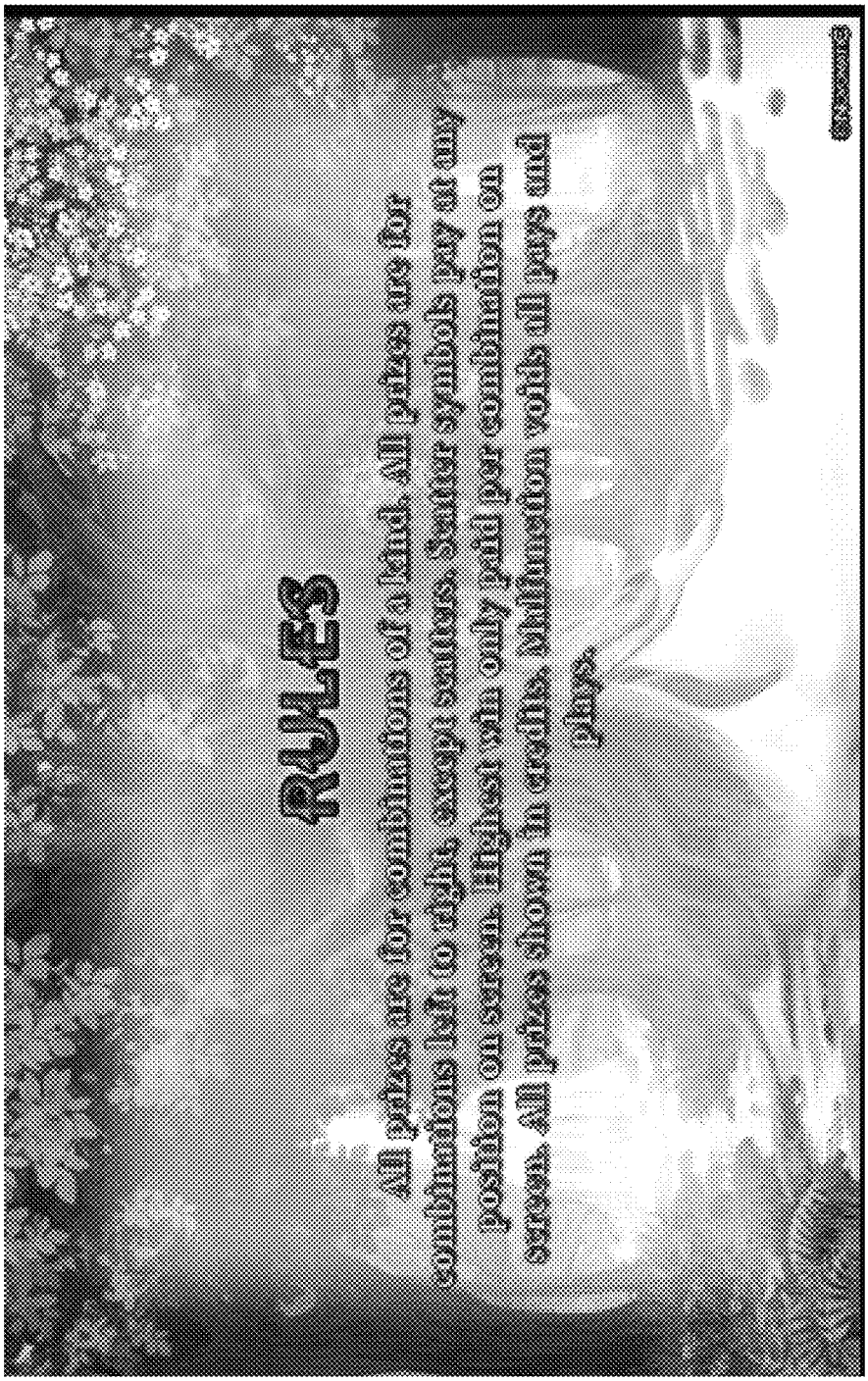
FIG. 5 is a screenshot of the rules for the bonus feature play in accordance with the present invention.

FIG. 5 shows a snapshot of the rules of the bonus feature play. It notifies that all prizes are for the combinations of a kind. Further, all prizes are only for the combinations running from left to right in the rows of the matrix. In addition, the scatter symbols are paid at any position on the screen or matrix. Further, the highest win is only paid per combination on the screen or matrix. Finally, all prizes are shown in credits only. It is also to be noted that any malfunction of the game voids all pays and plays of the game.

Figure 6:
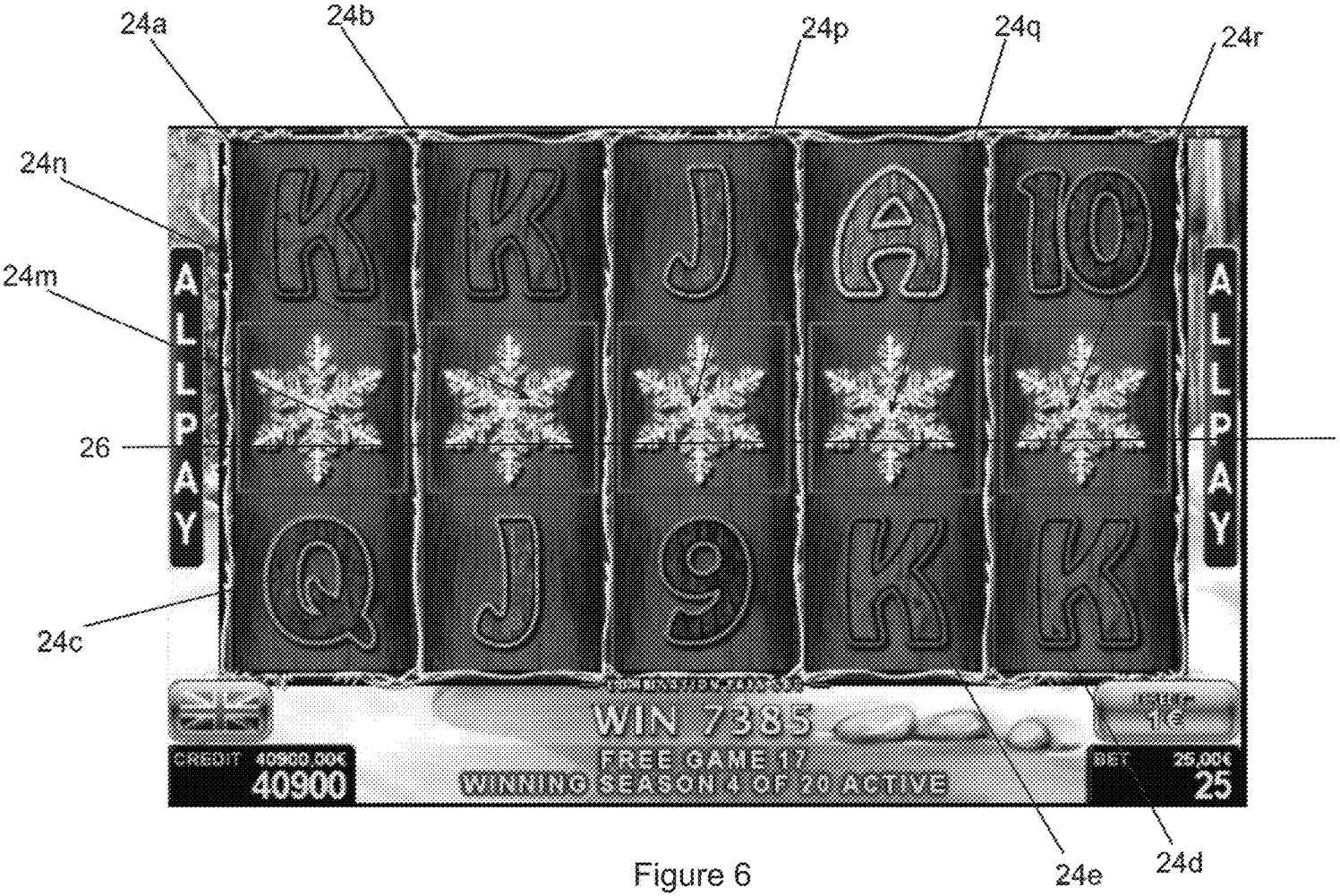
FIG. 6 is a screenshot of the display after continuing the "Winning Seasons" of the bonus feature play in accordance with the present invention.

FIG. 6 shows a payline 26 in the middle row having five "Stars". Since, the middle row includes a combination of a kind, i.e. "Stars" the "Winning seasons" is won by the player. As per the rules of the game, only the combination of two "K", 24*a* and 24*b* in the top row can win a prize, because it runs from left to right in the matrix. However, as per the rules shown in FIG. 5, the combination of two "K", 24*e* and 24*d* in the bottom row cannot win a prize, as it starts from right and runs leftwards in the matrix.

The position of the scatter symbols 24 in successive reel spins is determined randomly. In particular, the random numbers defining the reel stops of these 5 reels are the random numbers 1-3. The random numbers define vertical positions of each scatter symbol on any particular reel (i.e. columns of the matrix).

Each scatter symbol can take any of the three possible random vertical positions in response to random numbers 1 to 3, which are generated by the computer. Symbol position 1 is the uppermost position on a reel defined as row 1. Symbol position 2 is the middle position on row two of the reel. Symbol position 3 is the lowermost position on the reel.

Figure 7:
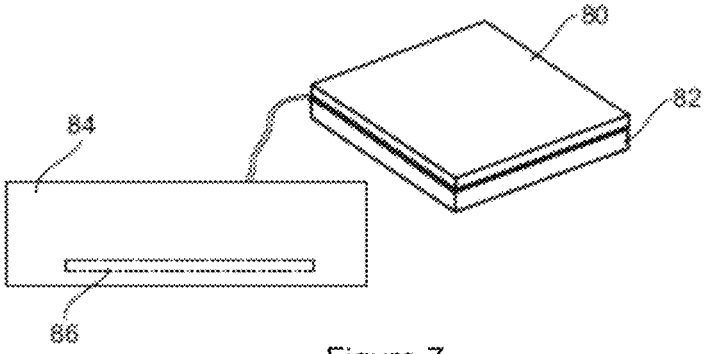
FIG. 7 is a perspective view of a computer and a display interface in accordance with the present invention.

FIG. 7 shows a computer 84, which is mounted in the housing 12 of the gaming machine 10. The computer 84 is connected to a display 80. The display 80 includes a transmissive LCD panel and may also include an integrated touch-screen 82. The computer 84 includes a PCB as the main board having a controller, memory for storing software for operating the display 80 which is also connected to the main board, software drivers, and a main processor, all mounted on the PCB. In a preferred embodiment, the computer 84 may include two displays to form an upper display 14*a* and a lower display 14*b* (see FIG. 1).

Figure 8:
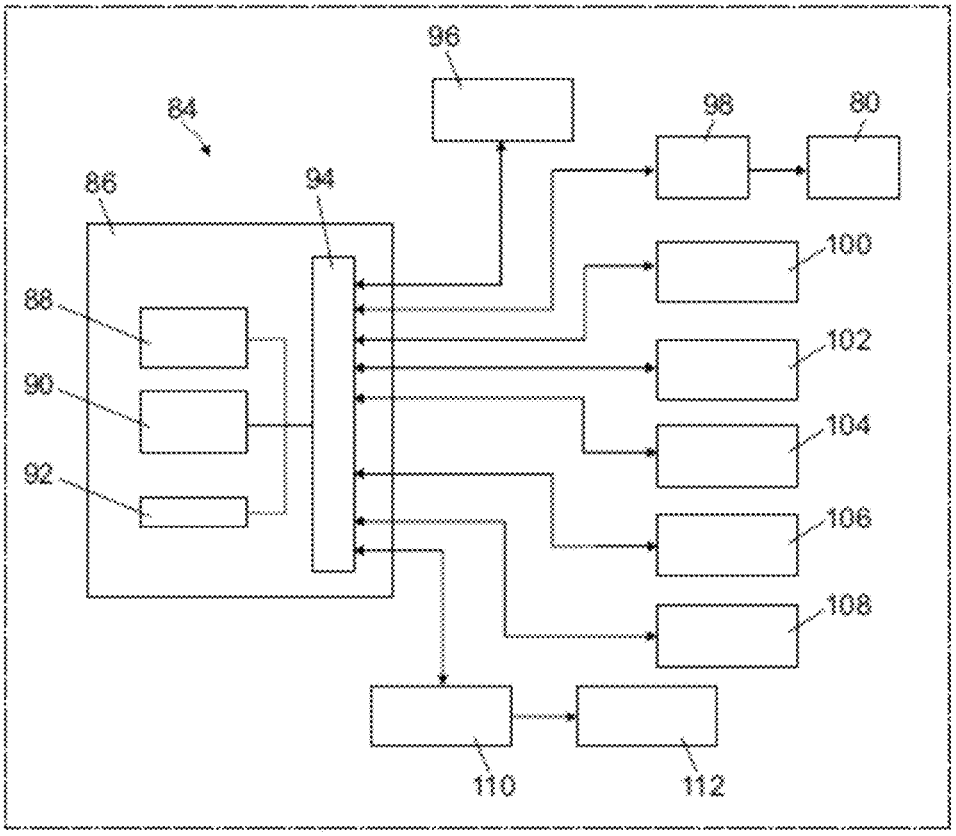
FIG. 8 is a system diagram in accordance with the present invention.

FIG. 8 shows a configuration diagram of the computer 84. The computer 84 includes a main board 86 or PCB, a program memory 88 configured as a computer readable medium, a main processor 90 and read only memory or RAM 92, all connected in operative communication with each other and also connected with an input output I/O controller 94 which in turn communicates with a user interface control panel 96, the display interface driver circuitry 98, a display unit 100, a coin receiver 102, a bill receiver 104, a card reader 106, a ticket reader/printer 108, and a sound circuit 110 respectively. The sound circuit 110 is in operative communication with speakers 112.

The coin receiver 102 and bill receiver 104 receive the respective currency and communicate the amount received therein to the I/O controller 94. The card reader 106 reads credit cards, debit cards, gift cards or other cards having electronic indicia of the monetary value.

The ticket reader 108 prints tickets and receipts revealing the winnings of a player, or other financial outcomes. The ticket reader 108 also receives tickets having indicia of monetary value, such as a bar code, which is read by the ticket reader 108.

The sound circuit 110 is configured to provide an acoustic-based interface for the user. Each movement or action by a user may result in a particular sound, or instruction being generated by the computer 84. The speakers 112 communicate the sounds to the user.

While the present invention is disclosed in terms of various specific embodiments, it can be appreciated that these embodiments are by way of example only. There are several variations contemplated by the present invention, and with the popularity of electronic gaming interfaces, the term "reel" should be broadly understood to include any set of moveable images, defining a matrix column, that are used to establish a payout. Accordingly, the scope of the invention is defined by the appended claims.

What is claimed is:

1. A gaining machine operated by a computer, the gaining machine having a standard game play mode and a bonus feature play mode that include winning and non-winning reel set spins, the gaming machine comprising:

a housing having a user interface and a display attached to the housing;

a computer adapted for operative communication with the user interface and the display, and during the standard game play mode, the computer communicates with the display to randomly display a matrix of symbols including scatter symbols;

a first evaluation means operated by the computer for evaluating scatter symbols in the matrix, whereby upon appearance of a predetermined number of scatter symbols in the matrix the evaluation means triggers bonus feature play mode and initializes an integer value win chain counter greater than zero, that is based on the number of scatter symbols appearing in the matrix, a second evaluation means operated by the computer during bonus feature play mode, wherein during the bonus feature play mode a winning reel set spin enables a new reel set spin while leaving the value of the win chain counter unchanged and while a non-winning reel set spin decrements the win chain counter wherein, when the win chain counter reaches a threshold value then bonus game play terminates otherwise a new reel set spin is enabled, during game play, including both standard game play mode and bonus feature play mode, at least three win chains are achieved, wherein the number of win chains is reflected in the win chain counter.

2. The gaining machine as set forth in claim 1, wherein upon termination of bonus feature play, the sum of winning spins in the first win chain yields bonus credits.

3. The gaining machine as set forth in claim 1, wherein upon termination of bonus feature play, the sum of winning spins in the win chains yield bonus credits to a player.

4. The gaining machine as set forth in claim 1, wherein bonus feature play commences when at least three scatter symbols appear.

5. The gaining machine as set forth in claim 4, wherein the bonus feature play yields a win chain counter having an integer value of four.

6. The gaining machine as set forth in claim 1, wherein the gaining machine calculates a payout based on a threshold number of win chains.

7. A gaining machine operated by a computer having a standard game play mode and a bonus feature play mode, the machine comprising:

a housing having at least one user interface attached to the housing;

a computer in operative communication with the user interface, the computer having a printed circuit board provided with a program memory for evaluating game play, storing the game play instructions and symbols, a main processor and random access memory, and an input/output controller, all connected in an operative communication with each other;

a user interface control panel connected to the input/output controller and connected to the user interface to enable the user to input game play instructions;

during the standard game play mode, the user interface randomly displays a matrix of symbols and the computer calculates winning reel set spins based on the matrix of symbols;

upon appearance of a predetermined number of scatter symbols in the matrix, bonus feature play commences and a win chain play counter is initialized having an integer value greater than zero, the win chain play counter being based on the number of scatter symbols appearing in the matrix;

wherein during the bonus feature play mode a winning reel set spin enables a new reel set spin while leaving the value of the win chain play counter unchanged and a non-winning reel set spin decrements the win chain play counter, when the win chain play counter reaches a threshold value then the bonus game play terminates otherwise a new reel set spin is enabled, during game play, including both standard game play mode and bonus feature play mode, at least three win chains are achieved, wherein the number of win chains is reflected in the win chain counter.

8. The gaining machine as set forth in claim 7, wherein when the integer value of the win chain counter is four and during bonus feature play the first non-winning reel spin decrements the win chain counter by one, whereby when the win chain counter threshold value is zero, bonus feature play terminates, and whereby the sum of winning reel set spins in the win chain yields bonus credits.

9. The gaining machine as set forth in claim 7, wherein upon termination of bonus feature play, the sum of winning spins in the win chain yields bonus credits to a player.

10. A method of operating a slot-machine game operated by a computer and having a display that displays matrix of symbols that may yield winning combinations, comprising:

providing a computer and a housing having a display and a user interface, the computer being mounted in the housing for controlling the display in response to the user interface;

initializing a win chain counter by establishing a win chain counter integer value greater than zero, the win chain play counter being based on the number of scatter symbols appearing in the matrix;

enabling reel set spins by randomly changing the matrix of symbols to yield a win by a winning reel set spin having a payline or a loss by a non-winning reel set spin not having a payline;

when a non-winning reel set spin is yielded, decrementing the win chain counter value by one and, if the win chain counter has reached a threshold value then the game terminates otherwise enabling repeating the step of randomly changing the matrix of symbols;

when a winning reel set spin is yielded, the win chain counter value remains constant and step of randomly changing the matrix of symbols is enabled to repeat, during game play, including both standard game play mode and bonus feature play mode, at least three win chains are achieved, wherein the number of win chains is reflected in the win chain counter.

11. The method of operating a slot-machine game as set forth in claim 10, wherein the computer is programmed with game software having both a standard game play mode and a feature game play mode, wherein the step of decrementing the win chain counter value is performed only in feature game play mode.

12. The method of operating a slot-machine game as set forth in claim 10, wherein the computer terminates bonus feature game play mode solely upon a non-win result and when the win chain counter threshold value is zero.

13. The method of operating a slot-machine game as set forth in claim 12, wherein the step of initializing a win chain counter reflects a value equal to a number of uninterrupted sequential winning spins.

14. The method of operating a slot-machine game as set forth in claim 13, wherein the slot machine is capable of standard game play mode and bonus feature game play mode, the step of initializing a win chain counter reflects a value equal to a number of uninterrupted sequential winning reel-set spins during standard game play mode.

15. The method of operating a slot-machine game as set forth in claim 14, wherein the step of initializing a bonus feature game play mode by initializing a win chain counter occurs upon appearance of more than one scatter symbol.

16. The method of operating a slot-machine game as set forth in claim 14, wherein the step of initializing a bonus feature game play mode by initializing a win chain counter including displaying "winning seasons" reflective of the win chain counter value.

* * * * *